US006056233A

United States Patent [19]

Von Schenk

[11] Patent Number: 6,056,233

[45] Date of Patent: May 2, 2000

[54] PROTECTIVE HOUSING FOR BATHROOM TOILET PAPER

[76] Inventor: David R. Von Schenk, 1970 128th Ave., NW., Coon Rapids, Minn. 55448

[21] Appl. No.: 09/072,648

[22] Filed: May 5, 1998

Related U.S. Application Data

[63] Continuation-in-part of application No. 08/743,014, Nov. 1, 1996, abandoned.

[51] Int. Cl.[7] ..... B65H 16/02; B65H 18/02; B65H 49/38; B65H 75/18

[52] U.S. Cl. ..... 242/594.5; 242/599.1; 242/598.6; 242/599; 242/598.5; 312/34.8; 312/34.21

[58] Field of Search ..... 242/905, 594.5, 242/599.1, 598.6, 599, 598.5, 597.8, 596.8; 312/34.1, 34.7, 34.8, 34.21, 34.22, 324, 245; 60/519

[56] References Cited

U.S. PATENT DOCUMENTS

| | | | |
|---|---|---|---|
| 694,987 | 3/1902 | Pollard | 312/100 |
| 991,979 | 5/1911 | Hano | 242/545.1 |
| 2,462,776 | 2/1949 | Price | 225/33 |
| 2,482,714 | 9/1949 | Mell | 225/38 |
| 2,576,526 | 11/1951 | Marchand | 242/598.5 |
| 2,722,387 | 11/1955 | Tuttle | 242/594.5 |
| 3,084,006 | 4/1963 | Roemer | 312/34.22 |
| 3,523,653 | 8/1970 | Hansen | 242/593 |
| 3,620,466 | 11/1971 | Bump | 242/560.1 |
| 4,108,513 | 8/1978 | Lander | 225/34 |
| 4,205,802 | 6/1980 | Economakis | 242/594.5 |
| 4,595,153 | 6/1986 | Goetz | 242/594.3 |
| 4,775,109 | 10/1988 | Tegg | 242/594.2 |
| 4,834,316 | 5/1989 | DeLorean | 242/594.5 |
| 4,844,368 | 7/1989 | Hu | 225/43 |
| 5,570,938 | 11/1996 | Butler | 312/45 |

*Primary Examiner*—Daniel P. Stodola
*Assistant Examiner*—Gregory J. Strimbu
*Attorney, Agent, or Firm*—Martin L. Stoneman

[57] ABSTRACT

A cover system for toilet paper to protect the toilet paper from dispersal by children and pets comprising a wall-mounted plastic casing completely covering upper and lower rolls of paper. The upper and lower rolls are covered by respective upper and lower swivelable covers, each having a safety latch system. Each safety latch system includes a pair of button-releasable latches with one button on each side of the casing and each cover may be released only by pushing both such buttons at the same time. The covers are light permeable and night lights may be mounted to the inside of the casing or as part of each holder going through each toilet paper roll.

28 Claims, 5 Drawing Sheets

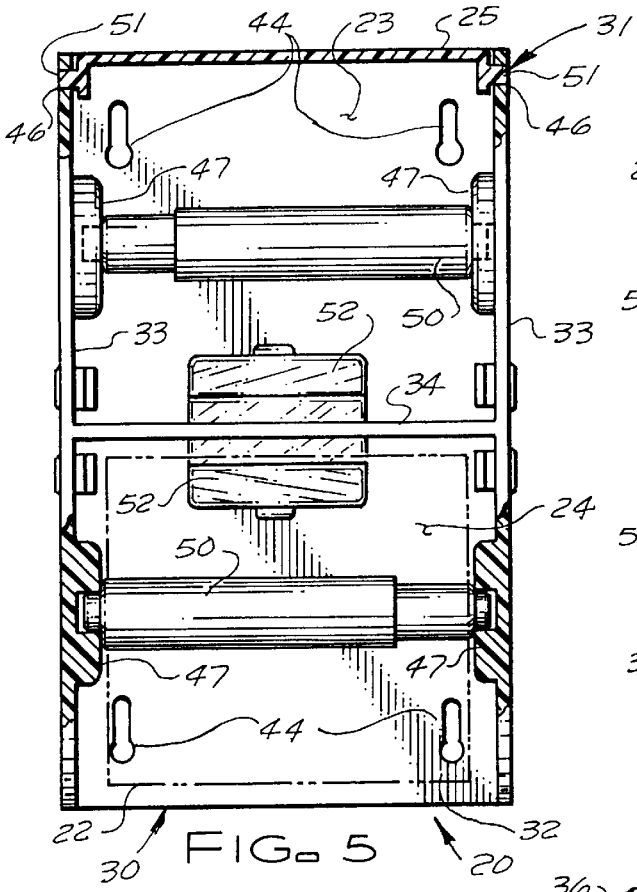
FIG. 5
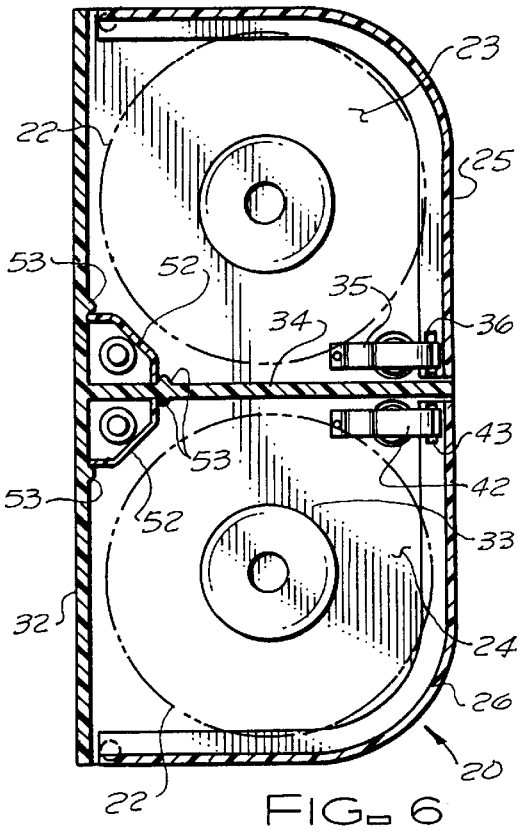
FIG. 6
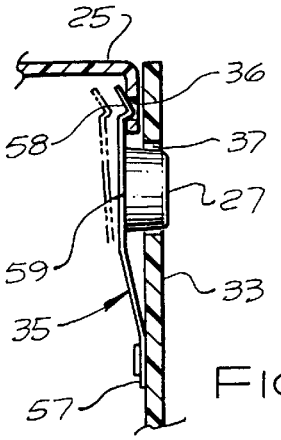
FIG. 9
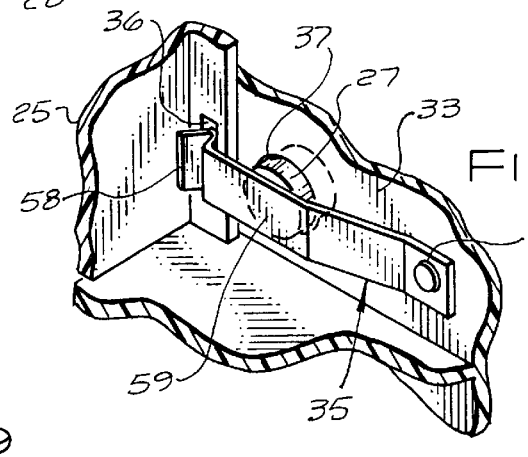
FIG. 8
FIG. 10
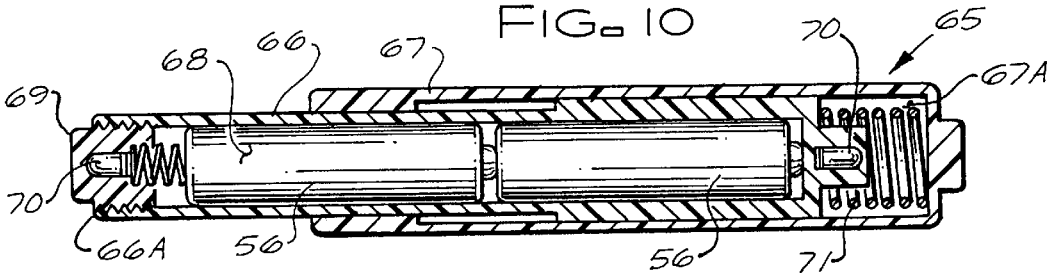

PROTECTIVE HOUSING FOR BATHROOM TOILET PAPER

CROSS-REFERENCE TO RELATED APPLICATIONS

This application is a continuation-in-part of application Ser. No. 08/743,014, filed Nov. 01, 1996, abandoned in favor of this application.

BACKGROUND OF THE INVENTION

1. Field of the Invention

This invention relates to providing a cover system for toilet paper dispensing. More particularly, this invention concerns a novel cover to protect the toilet paper from dispersal by children and pets.

2. Description of the Prior Art

Typically, in households with small children and/or pets, the homemaker is plagued by such children or pets pulling toilet paper out of the roll in a bathroom and leaving the pulled toilet paper in a mess all over the bathroom. This is both an inconvenience and a costly waste of toilet paper. Thus, there is an unmet need for an efficient and inexpensive system for restricting access to such rolls in such manner as to protect such toilet paper from dispersal by children and pets. And such need has not been met in a form including the providing of a bathroom night light and a housing providing child-protected entry.

Prior art attempts have been made to provide paper dispensers with a housing. For example, U.S. Pat. Nos. 4,844,368 and 2,722,387 disclose paper dispensers which provide a housing to facilitate dispensing at least one roll of paper. Though such devices may be adequate for their intended purpose, neither is adequate, e.g., neither teaches a cover system for paper dispensing which is designed to fully enclose both the paper rolls, including the paper roll free end, when the paper is not in use. For example, both patents teach paper dispenser systems which allow for exposure of the free end of the paper roll when the paper is not in use thereby making the paper roll vulnerable to dispersion by pets and small children.

OBJECTS OF THE INVENTION

A primary object of the present invention is to fulfill the above-mentioned needs by the provision of a cover system for toilet paper dispensing. A further primary object of the present invention is to provide such a system which is efficient, inexpensive, and handy. In addition, it is a primary object of this invention to provide such a system in connection with, and making use of, a novel cover to protect the toilet paper from dispersal by children and pets. Other objects of this invention will become apparent with reference to the following invention descriptions.

SUMMARY OF THE INVENTION

According to a preferred embodiment of the present invention, this invention provides a cover system for toilet paper dispensing comprising, in combination: frame means, having a first side and a second side, for partially enclosing and removably holding a roll of toilet paper for dispensing; attachment means for attaching such frame means to a bathroom structure; attached to such frame means, swivelable cover means for selectively completing full enclosing of such roll of toilet paper; latch means for holding such cover means closed; and latch release means for user release of such latch means. And it provides such a cover system for toilet paper dispensing wherein such latch release means comprises: a pair of user-operable latch releases structured and arranged for user release of such latch means only when both of such user-operable latch releases are user-operated at the same time. And, further, it provides such a cover system for toilet paper dispensing wherein one of such user-operable latch releases is located on such first side of such frame means, and one of such user-operable latch releases is located on such second side of such frame means. And, still further, it provides such a cover system for toilet paper dispensing wherein such pair of such user-operable latch releases is integrally attached to such cover means.

Moreover, this invention provides such a cover system for toilet paper dispensing wherein such cover means comprises: a cylinder having a first end line straight portion, a second end line straight portion, and, between such first and second end line straight portions, a concave portion normally positioned adjacent a roll of toilet paper; wherein such first end line straight portion is swivelably connected to such frame means and such second end line frame portion is detachably connected with such frame means by such latch means. Also, this invention provides such cover system for toilet paper dispensing wherein such cover means is light-permeable.

Yet further, this invention provides such a cover system further comprising lighting means for providing a light source situate within an enclosure formed by such frame means and such swivelable cover means. Additionally, it provides such a cover system for toilet paper dispensing wherein such light source is supported by such frame means. And, it provides such a cover system for toilet paper dispensing further comprising: toilet-paper-roll-support means, mounted within such enclosure, for internally supporting such toilet paper roll along a central axis of such toilet paper roll; wherein such light source is supported by such toilet-paper-roll-support means. And, further, it provides such a cover system wherein such latch release means comprises: a pair of user-operable latch releases structured and arranged for user release of such latch means only when both of such user-operable latch releases are user-operated at the same time. And, further still, it provides such cover system for toilet paper dispensing wherein one of such user-operable latch releases is located on such first side of such frame means, and one of such user-operable latch releases is located on such second side of such frame means.

Even additionally, according to a preferred embodiment thereof, this invention provides a housing for protecting a pair of rolls of toilet paper from dispersal by children and pets, such housing comprising: a normally-vertical planar back portion having attachment means for attaching such housing to a bathroom structure; a pair of normally-vertical planar side portions attached to such planar back portion, each extending from such planar back portion at about a right angle, such planar side portions comprising a first planar side portion and a second planar side portion; and such pair of such planar side portions being constructed and arranged for supporting a pair of toilet paper rolls; a normally-horizontal base portion attached to an inner surface of each respective such planar side portion about midway from a top of each such side portion to a bottom of each such side portion; a first cover portion, having an open position and a closed position, swivelably connected to a top of such planar back portion and structured and arranged to be detachably latched at such closed position of such first cover portion; and a second cover portion, having an open position and a closed position, swivelably connected to a bottom of such planar back portion and structured and arranged to be detachably latched at such closed position of such second cover portion; such housing being structured and arranged so that, when both such first and second cover portions are at their closed positions, such housing would fully enclose a such pair of toilet paper rolls.

Yet further, this invention provides such a housing further comprising: a first pair of user-operable latch releases structured and arranged for user release of such first cover portion when detachably latched at such closed position of such first pair of such user-operable latch releases; and a second pair of user-operable latch releases structured and arranged for user release of such second cover portion when detachably latched at such closed position of such second pair of such user-operable latch releases; each such respective pair of user-operable latch releases being structured and arranged for user release of a respective such cover portion only when both of such respective pair are user-operated at the same time. And it provides such a housing according to claim 13 wherein one of such first pair of such user-operable latch releases is located on such first planar side portion, and one of such first pair of such user-operable latch releases is located on such second planar side portion; and one of such second pair of such user-operable latch releases is located on such first planar side portion, and one of such second pair of such user-operable latch releases is located on such second planar side portion. It also provides such a housing wherein such first pair of user-operable latch releases is integrally attached to such first cover means, and such second pair of user-operable latch releases is integrally attached to such second cover means. Further, it provides such a housing wherein such cover portions are light-permeable; and, moreover, further comprising a light source situate within such housing; and, further, such a housing wherein such light source is supported by such back portion and such base portion.

Yet further, it provides such a housing further comprising toilet-paper-roll-support means for internally supporting a such toilet paper roll along a central axis of such toilet paper roll; wherein such light source is supported by such toilet-paper-roll-support means. Additionally, it provides such a housing further comprising: a first pair of user-operable latch releases structured and arranged for user release of such first cover portion when detachably latched at such closed position of such first pair of such user-operable latch releases; and a second pair of user-operable latch releases structured and arranged for user release of such second cover portion when detachably latched at such closed position of such second pair of such user-operable latch releases; each such respective pair of user-operable latch releases being structured and arranged for user release of a respective such cover portion only when both of such respective pair are user-operated at the same time. Yet additionally, it provides such a housing according to Claim 13 wherein: one of such first pair of such user-operable latch releases is located on such first planar side portion, and one of such first pair of such user-operable latch releases is located on such second planar side portion; and one of such second pair of such user-operable latch releases is located on such first planar side portion, and one of such second pair of such user-operable latch releases is located on such second planar side portion. And, it provides such a housing wherein each such user-operable latch release is operated by pressing a button. And, further still, this invention provides such a cover system wherein such first pair of such user-operable latch releases is integrally attached to such first cover portion, and such second pair of such user-operable latch releases is integrally attached to such second cover portion.

Additionally still, according to a preferred embodiment thereof, this invention provides a housing for protecting a pair of rolls of toilet paper from dispersal by children and pets, such housing comprising: a normally-vertical planar back portion having attachment means for attaching such housing to a bathroom structure; a pair of normally-vertical planar side portions each attached to such back portion, each extending from such back portion at about a right angle, and each of such planar side portions being separated by a separation distance, such pair of planar side portions being constructed and arranged for supporting a pair of rolls of toilet paper; a normally-horizontal divider portion having a bottom surface and being slidably attached to an inner surface, respectively, of each such planar side portion about midway from a top of each such planar side portion to a bottom of each such planar side portion, such divider portion being structured and arranged to span such separation distance between such planar side portions; divider support means, integrally attached to each such planar side portion, for supporting such divider portion; a first cover portion, having an open position and a closed position, swivelably connected to a top of such planar back portion and structured and arranged to be detachably latched at such closed position of such first cover portion; and a second cover portion, having an open position and a closed position, swivelably connected to a bottom of such planar back portion and structured and arranged to be detachably latched at such closed position of such second cover portion; such housing being structured and arranged so that, when both such first and second cover portions are at the respective such closed positions, such housing fully encloses such pair of rolls of toilet paper.

Additionally, this invention provides a housing further comprising: a first pair of user-operable latch releases structured and arranged for user release of such first cover portion when detachably latched at such closed position of such first pair of such user-operable latch releases; and a second pair of user-operable latch releases structured and arranged for user release of such second cover portion when detachably latched at such closed position of such second pair of such user-operable latch releases; each such respective pair of user-operable latch releases being structured and arranged for user release of a respective such cover portion only when both of such respective pair are user-operated at the same time. Further, this invention provides such a housing further comprising a lateral support portion: attached to each such respective inner surface of each respective such planar side portion, and normally adjacent to such bottom surface of such divider portion; and, moreover, wherein a light source is supported by such divider portion.

BRIEF DESCRIPTION OF THE DRAWINGS

FIG. 4 is a perspective exploded view of the enclosed double toilet paper roll holder.

FIG. 5 is a front elevation view, partially in section, at the toilet paper rolls, of the enclosed double toilet paper roll holder, further showing a preferred embodiment for lighting in the present system.

FIG. 6 is a left side cross-section (at the midsection) elevation view of the enclosed double toilet paper roll holder of FIG. 5.

FIG. 8 is a perspective view of the latch, according to a preferred embodiment of the present invention.

FIG. 9 is a cross-sectional plan view of the latch of FIG. 8.

FIG. 10 is a cross-sectional longitudinal view of an illuminated roll shaft, according to a preferred embodiment of the present invention.

DETAILED DESCRIPTION OF A PREFERRED EMBODIMENT AND THE BEST MODE OF PRACTICE

Figure 1:
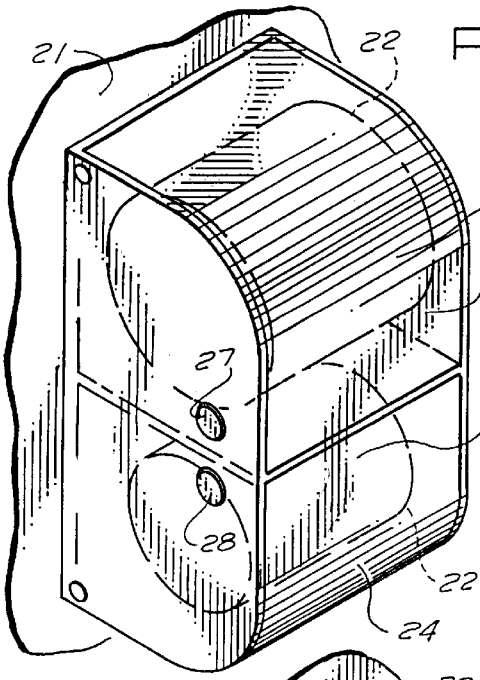
FIG. 1 is a perspective view of the preferred embodiment of the system of the present invention, specifically illustrating a covered and enclosed double toilet paper roll holder with light.

FIG. 1 is a perspective view of the preferred embodiment of an enclosed double toilet paper roll holder according to the present invention embodied by roll holder 20 which is mounted to bathroom wall 21. The roll holder 20 provides a holding means for two toilet paper rolls 22 within two fully enclosed and separate compartments, an upper compartment 23 and a lower compartment 24. The roll holder 20 incorporates two covers, a top cover 25 and a bottom cover 26, of which either may be respectively opened for access to the toilet paper rolls 22 within the respective upper or lower compartments 23 or 24. When both the top cover 25 and the bottom cover 26 are closed, the toilet paper rolls 22 within the upper compartment 23 and the lower compartment 24 are not accessible for use. Neither the top cover 25 nor the bottom cover 26 may be opened until the appropriate and corresponding pair of latch buttons 27 or 28 are depressed at the same time, releasing the internal latches which prevent the top cover 25 or the bottom cover 26 from being opened. This feature (that a pair of user-operable latch releases is herein structured and arranged for user release of such latch means only when both of such pair are user-operated at the same time) is greatly appreciated by those households who have been plagued by small children and/or pets pulling and leaving the pulled toilet paper in a mess all over the bathroom. This is both an inconvenience and a costly waste of toilet paper. The knowledge and dexterity required to operate the latch buttons 27 or 28 and then open either the top cover 25 or the bottom cover 26, prevents the very young child or pet from gaining access to the toilet paper roll 22; whereas a child with maturity and beyond the age of unwanted pulling of the toilet paper, can easily open the top cover 25 or the bottom cover 26 for access to the toilet paper rolls 22. In addition to providing the desired security, covering of the normally exposed toilet paper roll 22 adds an attractive appearance to the roll holder 20. Additionally, the roll holder 20 incorporates interior illumination as is described in FIGS. 4–7. The roll holder 20, including the top cover 25 and bottom cover 26 is constructed of plastic materials, which are preferably transparent or semi-transparent, providing a controlled interior view as well as allowing the interior lighting to serve as a night light for the bathroom.

Figure 2:
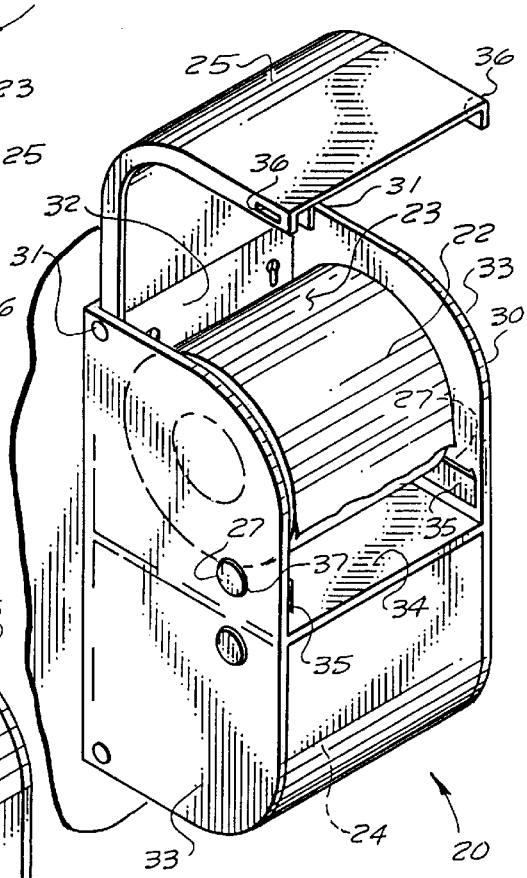
FIG. 2 is a perspective view of the enclosed double toilet paper roll holder with top cover open.
Figure 3:
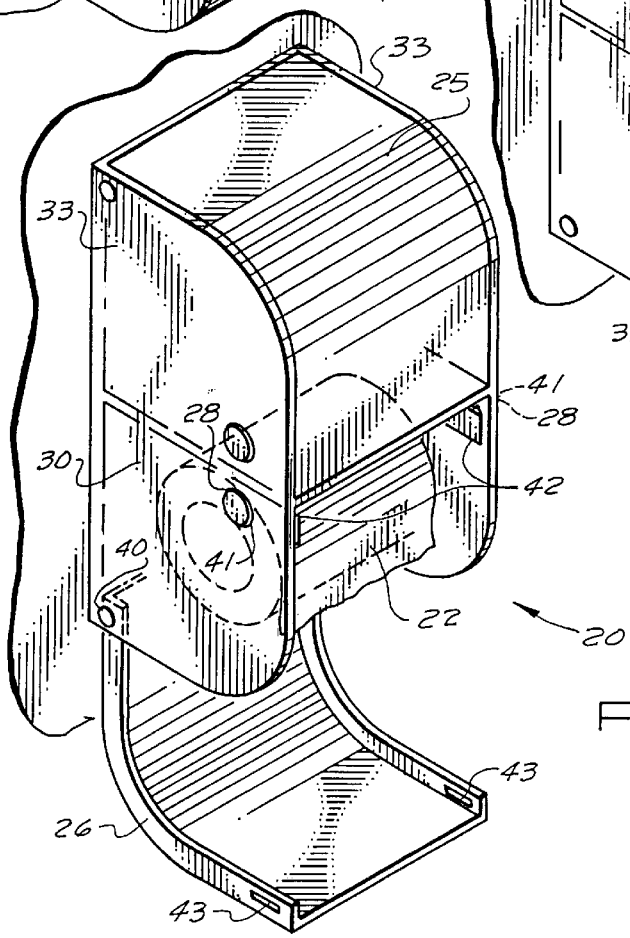
FIG. 3 is a perspective view of the enclosed double toilet paper roll holder with bottom cover open.

In FIGS. 2 and 3, the roll holder 20 is shown in perspective views with covers open and the toilet paper roll 22 accessible for use. FIG. 2 illustrates the top cover 25 of the roll holder 20 in an open position, exposing the interior of the upper compartment 23 and providing access to the toilet paper roll 22 within that upper compartment 23. The frame means of this invention for partially enclosing and removably holding a roll of toilet paper for dispensing is embodied herein by the housing 30 of the roll holder 20. The top cover 25, embodying the swivelable cover means of this invention for selectively completing full enclosing of such roll of toilet paper, is attached to the housing 30 of the roll holder 20 with a first horizontal hinge 31 located near the top rearward (near the wall) corner of the housing 30. The housing 30 is comprised of a vertical back plate 32, two vertical side plates 33, and a horizontal base plate 34 dividing the housing 30 into the upper compartment 23 and the lower compartment 24. Before the top cover 25 can be swung upward to an open position, two upper latches 35 (embodying herein a first pair of user-operable latch releases structured and arranged for user release of such first cover portion when detachably latched at such closed position of such first pair of such user-operable latch releases), which are operated by the corresponding latch buttons 27, must be actuated so that they release their engagement of the two latch slots 36 of top cover 25. Upper latches 35, embodying the latch means of this invention for holding such cover means closed, are attached to the side plates 33 within the upper compartment 23. Upper latches 35 include latch release means for user release of such latch means, embodied by the latch buttons 27 which protrude to the exterior of the side plates 33 through upper holes 37. When the top cover 25 is lowered to its closed position, latch slots 36 of the top cover 25 are self-engaging with the upper latches 35.

As shown in FIG. 3, the bottom cover 26 functions in the same manner as the top cover 25 as previously detailed in FIG. 2. The bottom cover 26 swings downward, rotating about the second horizontal hinge 40 located at the bottom rear corner of the housing 30. Latch buttons 28 are operable through lower holes 41 for disengaging lower latches 42 from latch slots 43 of the bottom cover 26. Lower latches 42 (embodying herein a second pair of user-operable latch releases structured and arranged for user release of such second cover portion when detachably latched at such closed position of such second pair of such user-operable latch releases) are attached to the side plates 33 within the lower compartment 24. When latch buttons 28 are depressed, the bottom cover 26 is unlatched, and it may be opened downward, exposing the lower compartment 24, allowing access the toilet paper roll 22 contained within. Upon raising the bottom cover 26 to close the lower compartment 24, latch slots 43 engage with the two lower latches 42, locking the bottom cover 26 in its closed position. It is seen that, according to a preferred embodiment of this invention, each such respective pair of user-operable latch releases being structured and arranged for user release of a respective such cover portion only when both of such respective pair are user-operated at the same time.

The components of the roll holder 20 are illustrated in the perspective exploded view of FIG. 4. The housing 30 is the main structure to which the remaining components are attached. The housing 30 consists of: a normally-vertical planar back portion, embodied herein by vertical back plate 32; a pair of normally-vertical planar side portions attached to such back portion, each such side portion extending from such back portion at about a right angle and each of such planar side portions being separated by a separation distance, such pair of planar side portions being constructed and arranged for supporting a pair of toilet paper rolls, said side portions being embodied herein by two side plates 33 extending forward from both the left and right sides of the vertical back plate 32; and a normally-horizontal base portion attached to an inner surface of each such side portion about midway from the top of each such side portion to the bottom of each such side portion, such base portion being embodied herein by base plate 34. The base plate 34 spans horizontally between the side plates 33 and the vertical back plate 32, at a mid-height position, and divides the roll holder 20 into the equally sized upper and lower compartments 23 and 24. The vertical back plate 32 contains four screw slots 44, one near each corner, for attachment to the bathroom wall 21 with four screws 45. On each side plate 33, near the upper and lower rear corners are hinge holes 46 for first and second horizontal hinges, 31 and 40, of top and bottom covers 25 and 26. On each side plate 33 above the base plate 34 is an upper hole 37 for latch buttons 27 of upper latches 35. Also on each side plate 33, below the base plate 34, is a lower hole 41 for a latch button 28 of lower latch 42. Within both the upper compartment 23 and the lower compartment 24, on each side plate 33, and centrally located, are circular protruding sockets 47 for the holding of the toilet paper rolls 22 on roll shafts 50. Each roll shaft 50 is of the common spring extending type for holding a toilet paper roll in position between opposing sockets. A first cover portion, having an open position and a closed position, swivelably connected to a top of such planar back portion and structured and arranged to be detachably latched at such closed position of such first cover portion, is embodied herein by top cover 25. The top cover 25 pivotally attaches to the housing 30 at the first horizontal hinge 31. This is accomplished with a stub shaft 51 extending outward from either side of the top cover 25 for mating with hinge holes 46 of the housing 30.

In like manner the bottom cover 26 (embodying a second cover portion, having an open position and a closed position, swivelably connected to a bottom of such planar back portion and structured and arranged to be detachably latched at such closed position of such second cover portion) incorporates a stub shaft 51, on either side, for pivoting within the hinge holes 46 of the housing 30 in establishing the second horizontal hinge 40. The top cover 25 incorporates latch slots 36 on each side for engaging with upper latches 35. Likewise, latch slots 43 are incorporated on either side of the bottom cover 26 for engagement with lower latches 42. An upper latch 35 is located on either side of the upper compartment 23 and attached to the inside of each side plate 33. The latch button 27 of each upper latch 35 extends through each side plate 33 at the upper hole 37. The lower latches 42 are attached to both side plates 33, in the lower compartment 24 below the base plate 34 with their latch buttons 28 projecting through the lower holes 41 of the side plates 33. Thus, it is seen that, as shown, the cover means of this invention comprises a cylinder as defined in the Random House Unabridged Dictionary (1969) as: "A surface or solid bounded by two parallel planes and generated by a straight line moving parallel to the given planes and tracing a curve bounded by the planes and lying in a plane perpendicular or oblique to the given planes." As shown best in FIG. 2, the cylinder comprises a first end line straight portion, a second end line straight portion, and, between such first and second end line straight portions, a concave portion normally positioned adjacent a such roll of toilet paper; wherein such first end line straight portion is swivelably connected to such frame means and such second end line frame portion is detachably connected with such frame means by such latch means.

Additionally, positioned in the adjoining corners of the vertical back plate 32 and the base plate 34 of the housing 30, in both the upper compartment 23 and the lower compartment 24 are two light assemblies 52. The light assemblies 52 are further described in FIGS. 5–7.

A front view of the housing 30 of the roll holder 20 is shown in FIG. 5. The vertical back plate 32 of the housing 30 contains four screw slots 44 for attachment to a bathroom wall. On each side of the housing 30 is a side plate 33. Adjoining the side plates 33 and the vertical back plate 32, at mid height, is the base plate 34, which divides the roll holder 20 into the upper and lower compartments 23 and 24. Within each of the upper and lower compartments 23 and 24 is a roll shaft 50 which is supported at both ends with protruding sockets 47 on each side plate 33. Shown with dotted lines is a toilet paper roll 22 positioned on the roll shaft 50 within the lower compartment 24. At the top of the roll holder 20 is, shown in cross section, the top cover 25 at the location of the first horizontal hinge 31. A stub shaft 51 is located on each side of the top cover 25 for pivoting within the hinge holes 46 located on the side plates 33. Thus, it is seen that, according to a preferred embodiment of this invention, such housing is structured and arranged so that, when both such first and second cover portions are at their closed positions, such housing would fully enclose a such pair of toilet paper rolls.

At the rear of each of the upper compartment 23 and lower compartment 24, at the adjoining corners where the base plate 34 intersects the vertical back plate 32 is a light assembly 52. The light assemblies 52 illuminate respectively the upper and lower compartment 23 and 24; and, additionally, since the housing 30 is preferably made of transparent plastic, may serve as a bathroom night light. According to a preferred embodiment of this invention, at a minimum, at least the cover means of this invention is light-permeable.

In FIG. 6 a cross-section elevation view shows the right side interior of the roll holder 20. The toilet paper rolls 22, shown by dotted lines, are centrally positioned within the upper and lower compartments 23 and 24. An upper latch 35, attached to the side plates 33, is shown latching the top cover 25 closed at the latch slot 36 of the top cover 25. In the same manner, a lower latch 42, within the lower compartment 24, engages with the latch slot 43 of the bottom cover 26. The two light assemblies 52 may be retained within the housing 30 with protruding bumps 53 on the vertical back plate 32 and the base plate 34. This allows for the light assemblies 52 to be removed and replaced for maintenance.

Figure 7:
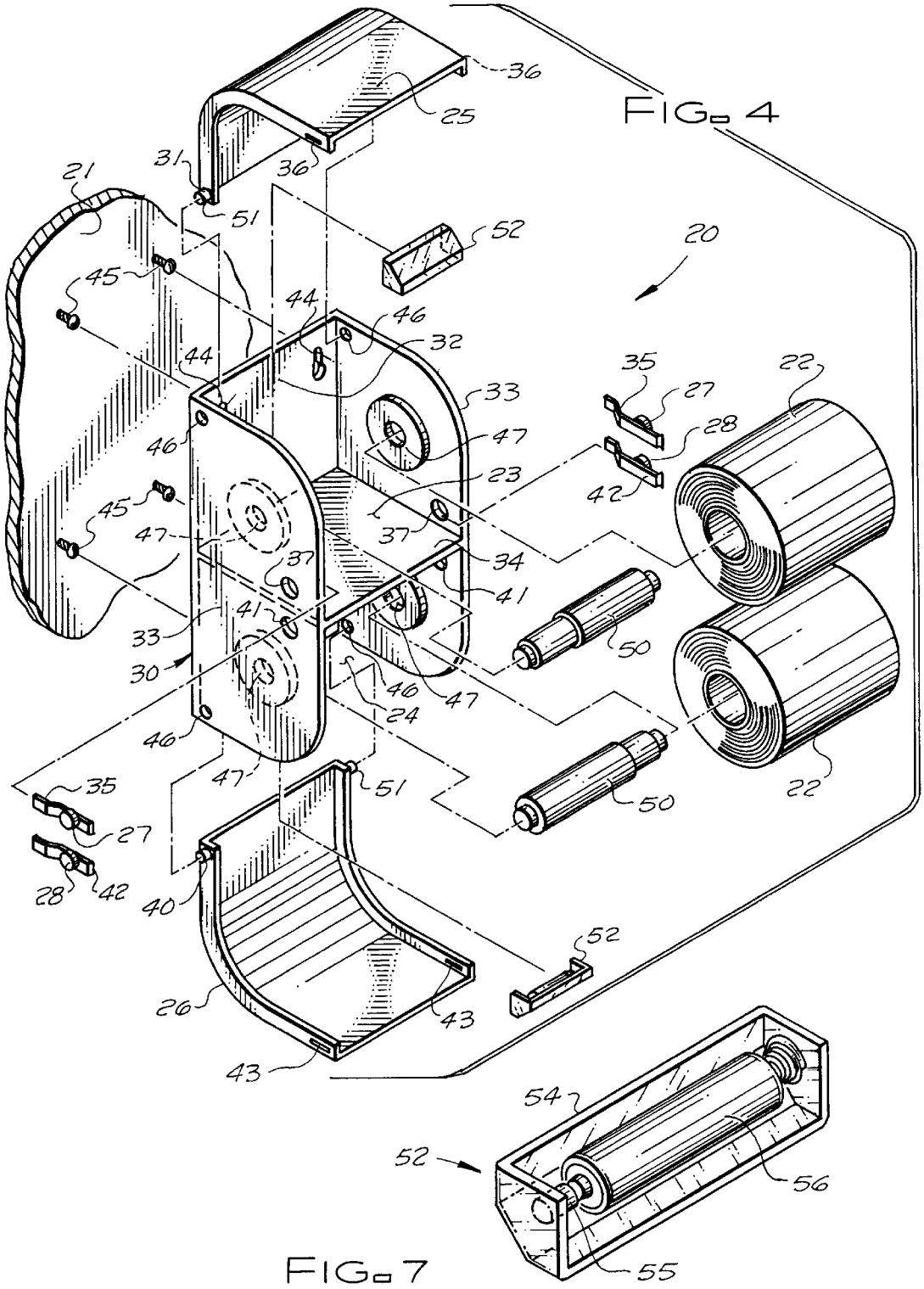
FIG. 7 is a rear perspective view of a light assembly according to a preferred embodiment of the present invention.

A perspective view of the rear of a light assembly 52 is shown in FIG. 7. The light assembly 52 consists of a transparent plastic lens 54 with an integral LED light and well-known circuitry 55 and containment for a replaceable AA size battery 56.

Details of an upper latch 35 are shown in perspective in FIG. 8 and in plan view in FIG. 9. Configuration and operation of the lower latches 42 is identical. Upper latch 35 is constructed of a flat strip of spring steel and formed to a shape to provide a stationary end 57, an engagement end 58, and a button location 59. The latch's 35 stationary end 57 is permanently attached to the side plate 33 of the housing 30 by any suitable means such as integral molding, adhesives, rivets. etc. Integral with the upper latch 35, and at the button location 59 is latch button 27. Latch button 27 protrudes through the upper hole 37 of the side plate 33. The engagement end 58 of upper latch 35 engages with the latch slot 36 of top cover 25. The top cover 25 remains latched closed until the upper latches 35 are actuated by the user. Depressing the latch buttons 27 deflects the upper latches 35 until the engagement ends 58 no longer engage the latch slots 36 and the top cover 25 can then be opened.

An alternate embodiment of the light assembly is shown in a cross-sectional longitudinal view in FIG. 10. An illuminating roll shaft 65 is detailed. The basic construction which is typical and common with spring extended roll shafts is retained and a lighting means is incorporated. The inner plunger 66 and outer housing 67, having a housing cavity 67A therein, are made from transparent plastic to allow light transmission from the light source within. The inner plunger 66 contains a cavity 68 for containment of standard AA size batteries 56 (embodying herein a power means, disposed within such inner plunger cavity, for supplying electric power to such lighting means) and the cavity 68 is accessed through removal of the threaded cap 69 (embodying herein a removable capping means for closing such open first end of such inner plunger cavity). The threaded cap 69 is attached, preferably by a threaded attachment, to the inner plunger substantially open first end 66A as shown. The inner plunger 66 and its threaded cap 69 contain an integral LED 70 (embodying herein a lighting means for illuminating such roll holder) along with the necessary circuit components. Disposed within the housing cavity 67A is a helical spring 71 (embodying herein a compressible urging means for urging such plunger second end away from such housing first end) which is used to provide a means to removably attach the roll shaft 65 to a conventional toilet paper roll shaft holder (not shown). Thus, as shown, according to a preferred embodiment of this invention, it provides a toilet-paper-roll-support means for internally supporting a such toilet paper roll along a central axis of such toilet paper roll; wherein a light source is supported by such toilet-paper-roll-support means.

Figure 11:
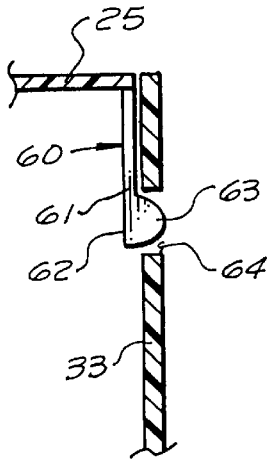
FIG. 11 is a cross-sectional plan view of the latch, according to another preferred embodiment of the present invention.
Figure 12:
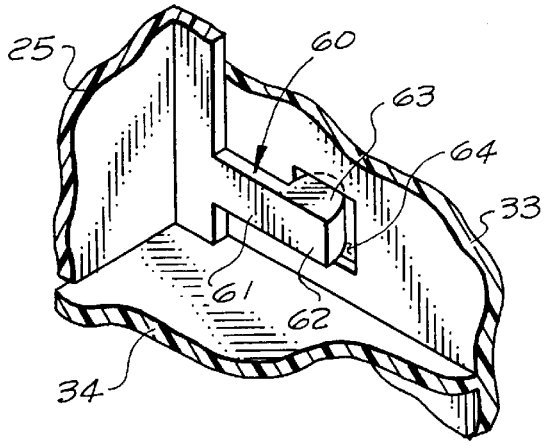
FIG. 12 is a perspective view of the latch of FIG. 11.

An alternate preferred embodiment of the method of latching the top cover 25 is shown in a cross-sectional plan view in FIG. 11 and in perspective in FIG. 12. According to this embodiment, the top cover 25 is provided with a pair of upper latching tabs 60 which are integrally formed as part of the top cover 25. This arrangement embodies herein an arrangement wherein such first pair of such user-operable latch releases is integrally attached to such first cover portion. Each upper latching tab 60 comprises an elongated bar portion 61 having a first end 62. Integrally affixed adjacent to the first end 62 of each elongated bar portion 61 is a tab button 63. The tab button 63 is structured and arranged to protrude through corresponding tab slots 64 which are formed in each side plate 33. When the top cover 25 is lowered to its closed position, each tab button 63 engages a corresponding tab slot 64 thereby preventing the top cover 25 from opening. Depressing each upper latching tab 60 deflects each elongated bar portion 61 thereby disengaging each tab button 63 from the corresponding tab slots 64 which allows the top cover 25 to be opened. The configuration and operation of the lower latching tabs 72 (as shown best in FIG. 14) is identical to the herein illustrated and described upper latching tab 60. This arrangement embodies herein an arrangement wherein such second pair of such user-operable latch releases is integrally attached to such second cover portion. As in the preferred embodiment hereinbefore illustrated and described with respect to FIGS. 1–9, this alternate preferred embodiment embodies an arrangement wherein each such respective pair of user-operable latch releases being structured and arranged for user release of a respective such cover portion only when both of such respective pair are user-operated at the same time.

Figure 13:
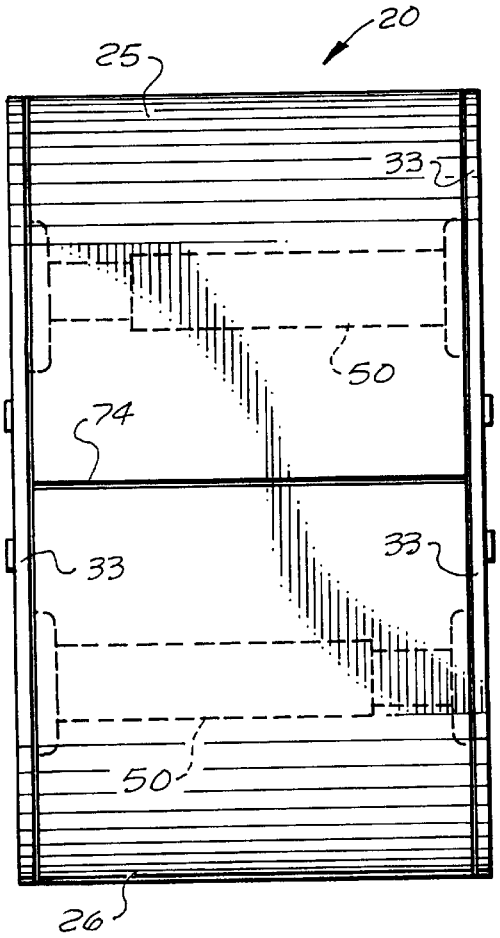
FIG. 13 is a front elevation view of the enclosed double toilet paper roll holder, according to another preferred embodiment of the present invention.
Figure 14:
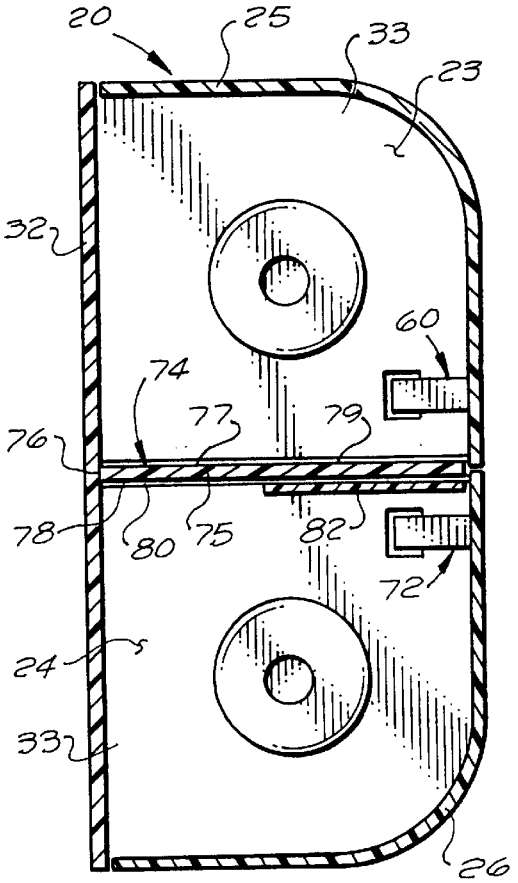
FIG. 14 is a left side cross-section (at the midsection) elevation view of the enclosed double toilet paper roll holder of FIG. 13.
Figure 15:
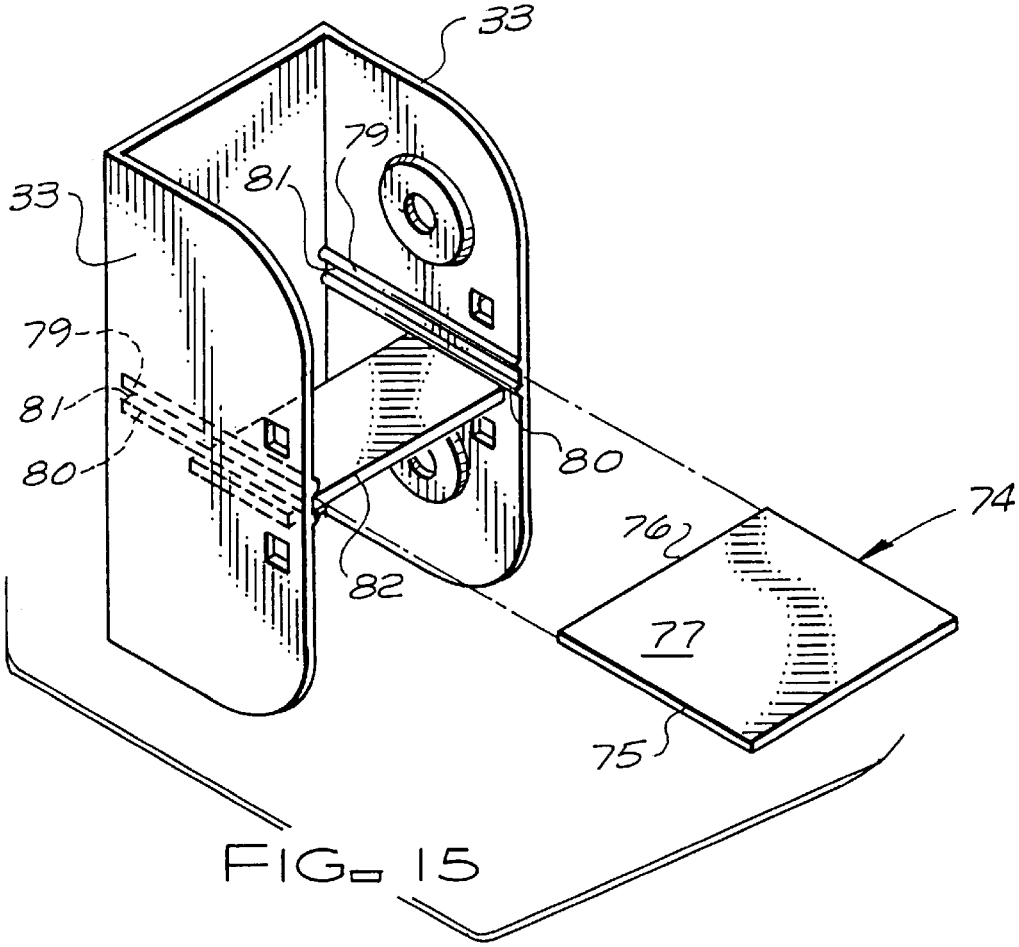
FIG. 15 is a perspective partially exploded view of the enclosed double toilet paper roll holder specifically illustrating the placement of the removable divider.

FIGS. 13–15 illustrate an alternate preferred embodiment of the roll holder 20 of the present invention. Shown in a front elevation view in FIG. 13 is the roll holder 20 as substantially illustrated and described with respect to FIGS. 1–6. According to the alternate preferred embodiment of the present invention, roll holder 20 is provided with a removable divider 74 (embodying herein a normally-horizontal divider portion having a bottom surface and being slidably attached to an inner surface, respectively, of each such planar side portion about midway from a top of each such planar side portion to a bottom of each such planar side portion, such divider portion being structured and arranged to span such separation distance between such planar side portions), preferably made of a transparent or semi-transparent plastic material, having a tray portion 75 (as shown in FIGS. 14–15), a rear surface 76, a tray portion top surface 77, and a tray portion bottom surface 78. As shown in the cross-sectional, left side elevation view in FIG. 14, the removable divider 74 is supported inside the roll holder 20 by means of an upper guide 79 and a lower guide 80 (embodying herein divider support means, integrally attached to each such planar side portion, for supporting such divider portion) which are integrally formed on each of side plates 33. Both the upper guide 79 and a lower guide 80 are structured and arranged so as to maintain the removable divider 74 at a mid-height location along side plates 33. Also shown in FIG. 14 are the latching tabs (60 and 72) illustrated and described with respect to the embodiment shown in FIGS. 11 and 12. It is to be understood that the latching tab embodiment illustrated and hereinbefore described with respect to FIGS. 1–9 may also be used in this embodiment without deviating from the spirit of the present invention.

As shown best in FIG. 14, the upper guide 79 and lower guide 80 are spaced so as to form a divider gap 81 (shown best in FIG. 15) which is of sufficient size so as to allow for passage of the tray portion 75 therein. As shown in the partial exploded view of FIG. 15, installation of the removable divider 74 consists of placing the tray portion 75 within each divider gap 81 and pushing the removable divider 74 until the rear surface 76 abuts the vertical back plate 32. Divider 74 embodies herein a normally-horizontal divider portion having a bottom surface and being slidably attached to an inner surface, respectively, of each said planar side portion about midway from a top of each said planar side portion to a bottom of each said planar side portion, said divider portion being structured and arranged to span said separation distance between said planar side portions. To provide lateral stability to the roll holder 20, a support plate 82, preferably made of a transparent or semi-transparent plastic material, is affixed to each of said side plates 33 normally adjacent to said bottom surface 78 of said divider 74.

Figure 16:
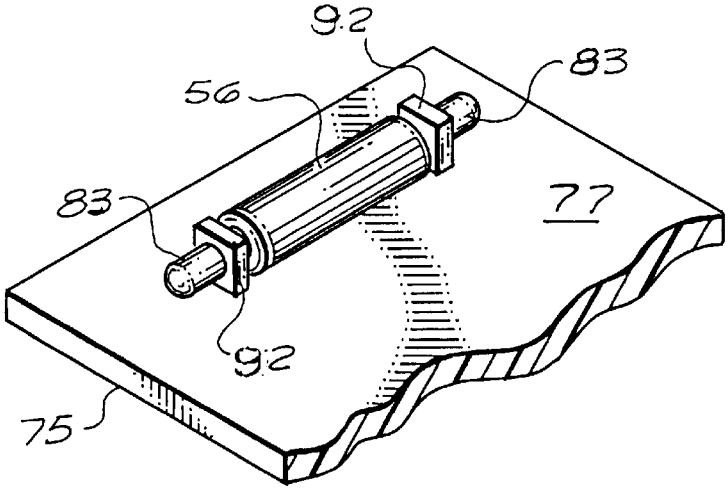
FIG. 16 is a partial perspective view of a light assembly according to yet another preferred embodiment of the present invention.

Yet another alternate preferred embodiment of the light assembly is shown in a partial perspective view in FIG. 16. Shown is the tray portion 75 of the removable divider 74 of the type hereinbefore illustrated and described with respect to FIGS. 13–15. The top surface 77 of the tray portion 75 is provided with a pair of tabs 92, integral to the tray portion 75, and structured and arranged to incorporate at least one battery 56 (preferably of AA size) therebetween. To provide illumination to the cover system 20, lights 83, preferably LED's, are attached to each tab 92 and are wired to battery(s) 56 by conventional circuitry.

Although applicant has described applicant's preferred embodiments of this invention, it will be understood that the broadest scope of this invention includes such modifications as diverse shapes and sizes and materials. Such scope is limited only by the below claims as read in connection with the above specification. Further, many other advantages of applicant's invention will be apparent to those skilled in the art from the above descriptions and the below claims.

What is claimed is:

1. A cover system for at least one roll of toilet paper comprising, in combination:

a. frame means, having a first side and a second side, for partially enclosing and removably holding, within an interior thereof, the at least one roll of toilet paper for dispensing;

b. attachment means for attaching said frame means to a bathroom structure;

c. swivelably attached to said frame means, at least two swivelable cover means for closing off the interior of the frame means for preventing the dispensing of the at least one roll of toilet paper when in a closed position, said at least two cover means are pivotable in opposing directions between said closed position and an open position, said at least two cover means and said frame means, together, fully enclose the at least one roll of toilet paper when said at least two cover means are in the closed position;

d. latch means for holding each said cover means in said closed position; and e. latch release means for user release of each said latch means;

f. spindle support means directly attached to said first and second sides of said frame means for supporting a toilet paper spindle.

2. A cover system according to claim 1 wherein each of said latch release means comprises:

a. a pair of user-operable latch releases structured and arranged for user release of a respective one of said latch means only when both of said user-operable latch releases are user-operated at the same time.

3. A cover system according to claim 2 wherein for each said pair of user-operable latch releases one of said user-operable latch releases is located on said first side of said frame means, and the other of said user-operable latch releases is located on said second side of said frame means.

4. A cover system according to claim 2 wherein each of said pair of said user-operable latch releases is integrally attached to a respective one of said cover means.

5. A cover system according to claim 1 wherein each of said cover means comprises:

a. a cylindrically shaped structure having a first straight portion, a second straight portion, and, between said first and second straight portions, a concave portion;

b. wherein said first straight portion is swivelably connected to said frame means and said second straight portion is detachably connected with said frame means by a respective one of said latch means.

6. A cover system according to claim 5 wherein each of said cover means is light-permeable.

7. A cover system according to claim 6, further comprising lighting means for providing a light source situate within said interior of said frame means.

8. A cover system according to claim 7 wherein said light source is supported by said frame means.

9. A cover system according to claim 7 further comprising:

a. said toilet paper spindle being mounted within said interior of said frame means for internally supporting said toilet paper roll along a central axis of said toilet paper roll;

b. wherein said light source is supported by said toilet paper spindle.

10. A cover system according to claim 7 wherein each of said latch release means comprises:

a. a pair of user-operable latch releases structured and arranged for user release of a respective one of said latch means only when both of said user-operable latch releases are user-operated at the same time.

11. A cover system according to claim 10 wherein for each of said pair of user-operable latch releases one of said user-operable latch releases is located on said first side of said frame means, and the other of said user-operable latch releases is located on said second side of said frame means.

12. A housing for protecting a pair of rolls of toilet paper from dispersal by children and pets, said housing comprising:

a. a normally-vertical planar back portion having attachment means for attaching said back portion to a bathroom structure;

b. a pair of normally-vertical planar side portions attached to said planar back portion, each extending from said planar back portion at about a right angle with respect to said planar back portion, i. said pair of said planar side portions comprising spindle support means directly attached thereto for supporting a toilet paper spindle;

c. a normally-horizontal planar base portion attached to an inner surface of each of said planar side portions about midway between a top and a bottom of each of said portions, said base portion substantially spanning a distance between said planar side portions;

d. a first cover, having an open position and a closed position, swivelably connected to a top of said planar back portion and structured and arranged to be detachably latched in said closed position of said first cover; and e. a second cover, having an open position and a closed position, swivelably connected to a bottom of said planar back portion and structured and arranged to be detachably latched in said closed position of said second cover;

f. said housing being structured and arranged so that, when both said first and second covers are in a respective said closed position, said housing fully encloses the pair of rolls of toilet paper and prevents a dispensing of the toilet paper from the pair of rolls of toilet paper.

13. A housing according to claim 12 further comprising:

a. a first pair of user-operable latch releases structured and arranged for user release of said first cover when detachably latched in said closed position of said first cover; and b. a second pair of user-operable latch releases structured and arranged for user release of said second cover when detachably latched in said closed position of said second cover;

c. each said pair of user-operable latch releases being structured and arranged for user release of a respective said cover only when both of said latch releases are user-operated at the same time.

14. A housing according to claim 13 wherein:

a. one of said first pair of said user-operable latch releases is located on one of said planar side portions, and the other one of said first pair of said user-operable latch releases is located on the other one of said planar side portions; and b. one of said second pair of said user-operable latch releases is located on said one of said planar side portions, and the other one of said second pair of said user-operable latch releases is located on said other one of said planar side portions.

15. A housing according to claim 14 wherein each said user-operable latch release is operated by pressing a button.

16. A housing according to claim 13 wherein said first pair of user-operable latch releases is integrally attached to said first cover, and said second pair of user-operable latch releases is integrally attached to said second cover.

17. A housing according to claim 12 wherein said covers are light-permeable.

18. A housing according to claim 17 further comprising a light source situate within said housing.

19. A housing according to claim 18 wherein said light source is supported by said back portion and said base portion.

20. A housing according to claim 18 further comprising:

a. said toilet paper spindle mounted within said housing for supporting one of the pair of rolls toilet paper along a central axis of the one of the pair of rolls toilet paper;

b. wherein said light source is supported by said toilet paper spindle.

21. A housing according to claim 18 further comprising:

a. a first pair of user-operable latch releases structured and arranged for user release of said first cover when detachably latched in said closed position of said first cover; and b. a second pair of user-operable latch releases structured and arranged for user release of said second cover when detachably latched in said closed position of said second cover;

c. each said pair of user-operable latch releases being structured and arranged for user release of a respective said cover only when both of said latch releases are user-operated at the same time.

22. A housing according to claim 21 wherein said first pair of said user-operable latch releases is integrally attached to said first cover, and said second pair of said user-operable latch releases is integrally attached to said second cover.

23. A housing for protecting a pair of rolls of toilet paper from dispersal by children and pets, said housing comprising:

a. a normally-vertical planar back portion having attachment means for attaching said back portion to a bathroom structure;

b. a pair of normally-vertical planar side portions each attached to said back portion, each extending from said back portion at about a right angle with respect to said back portion, and said planar side portions being separated by a separation distance, i. said pair of planar side portions comprising spindle support means directly attached therto for supporting a toilet paper spindle;

c. a normally-horizontal divider portion having a bottom surface and being slidably attached to an inner surface of each of said planar side portions about midway between a top and a bottom of each of said planar side portions, said divider portion being structured and arranged to span said separation distance between said planar side portions;

d. divider support means, integrally attached to each of said planar side portions, for supporting said divider portion;

e. a first cover, having an open position and a closed position, swivelably connected to a top of said planar back portion and structured and arranged to be detachably latched in said closed position of said first cover; and f. a second cover, having an open position and a closed position, swivelably connected to a bottom of said planar back portion and structured and arranged to be detachably latched in said closed position of said second cover;

g. said housing being structured and arranged so that, when both said first and second covers are in a respective said closed position, said housing fully encloses said pair of rolls of toilet paper and prevents a dispensing of the toilet paper from the pair of rolls of toilet paper.

24. A housing according to claim 23 further comprising:

a. a first pair of user-operable latch releases structured and arranged for user release of said first cover when detachably latched in said closed position of said first cover; and b. a second pair of user-operable latch releases structured and arranged for user release of said second cover when detachably latched in said closed position of said second cover;

c. each said pair of user-operable latch releases being structured and arranged for user release of a respective said cover only when both of said latch releases are user-operated at the same time.

25. A housing according to claim 24 further comprising a lateral support portion:

a. attached to said inner surfaces of said planar side portions, and b. normally adjacent to said bottom surface of said divider portion.

26. A housing according to claim 25 wherein a light source is supported by said divider portion.

27. A roll holder for supporting a roll of toilet paper comprising, in combination:

a. a cylindrical inner plunger having an outer surface and having an inner plunger cavity, said inner plunger cavity having an substantially open plunger first end and a substantially closed plunger second end;

b. a cylindrical outer housing having a closed housing first end and having an outer housing cavity therein, said outer housing cavity slidably engaging said outer surface of said inner plunger;

c. a lighting means for illuminating said roll holder;

d. a power means, disposed within said inner plunger cavity, for supplying electric power to said lighting means;

e. a removable capping means for closing said substantially open first end of said inner plunger cavity; and f. a compressible urging means for urging said plunger second end away from said housing first end;

g. wherein said inner plunger and said outer housing are structured and arranged to provide support along a central axis of said roll of toilet paper.

28. A roll holder according to claim 27 wherein said lighting means comprises light emitting diodes attached adjacent said first end and adjacent said second end of said inner plunger.

* * * * *